United States Patent [19]

Thomsen

[11] Patent Number: 4,648,739

[45] Date of Patent: Mar. 10, 1987

[54] LOAD TRANSFER CELL ASSEMBLY FOR CONCRETE PAVEMENT TRANSVERSE JOINTS

[76] Inventor: Bernard D. Thomsen, 117 S. Mayfair Dr., Mankato, Minn. 56001

[21] Appl. No.: 713,810

[22] Filed: Mar. 20, 1985

[51] Int. Cl.[4] ..... E01C 11/02; E01F 5/00

[52] U.S. Cl. ..... 404/2; 404/49; 404/60; 404/62; 404/68

[58] Field of Search ..... 404/47, 49–52, 404/56, 60, 2, 62, 63, 68; 52/396, 378, 573; 14/16.5

[56] References Cited

U.S. PATENT DOCUMENTS

| | | | |
|---|---|---|---|
| 1,040,731 | 10/1912 | Moore | 404/54 |
| 1,289,688 | 12/1918 | Davis | 404/68 |
| 1,566,319 | 12/1925 | Fischer | 404/61 |
| 1,586,326 | 5/1926 | Older | 404/51 |
| 1,806,275 | 5/1931 | Adler | 404/50 |
| 1,880,725 | 10/1932 | Bleck | 404/48 |
| 2,025,449 | 12/1935 | Heltzel | 404/74 |
| 2,040,367 | 5/1936 | Eichelman et al. | 404/63 |
| 2,042,524 | 6/1936 | Hall et al. | 404/48 |
| 2,082,805 | 6/1937 | Methven | 404/63 |
| 2,152,751 | 4/1939 | Schulz | 404/58 |
| 2,186,104 | 1/1940 | Geyer et al. | 404/60 |
| 2,187,912 | 1/1940 | Peirce | 404/56 |
| 2,197,438 | 4/1940 | Ridgely | 404/62 |
| 2,203,078 | 6/1940 | Carter | 404/47 X |
| 2,208,000 | 7/1940 | Geyer | 404/2 |
| 2,224,148 | 12/1940 | Fischer | 404/61 |
| 2,269,449 | 1/1942 | Fischer | 404/49 |
| 2,269,703 | 1/1942 | Bagwill | 404/60 |
| 2,316,233 | 4/1943 | Fischer | 404/60 |
| 2,330,214 | 9/1943 | Heltzel | 404/51 |
| 2,349,910 | 5/1944 | Methven | 404/2 |
| 2,508,443 | 5/1950 | Carter | 404/60 |
| 2,649,720 | 8/1953 | Heltzel | 404/2 |
| 2,674,164 | 4/1954 | Brickman | 404/63 |
| 2,700,329 | 1/1955 | Carter | 404/49 |
| 2,839,973 | 6/1958 | Heltzel | 404/2 |
| 3,059,553 | 10/1962 | Woolley | 404/62 |
| 4,522,531 | 6/1985 | Thomsen et al. | 404/2 |

*Primary Examiner*—James A. Leppink
*Assistant Examiner*—Matthew Smith
*Attorney, Agent, or Firm*—Schroeder & Siegfried

[57] ABSTRACT

A non-corrosive load transfer cell assembly for transverse joints in concrete pavement structures including support chairs, a pair of plastic walls abutting the edges of the concrete joints, a drainage trough for continuous drainage flow, a joint forming guide to wet form the upper portion of the joint through the concrete material, and compressed elastomers which space the wall liners apart and cooperate with threaded compression means to provide a load transfer supplement to steel dowels which pass through the elastomers.

20 Claims, 8 Drawing Figures

LOAD TRANSFER CELL ASSEMBLY FOR CONCRETE PAVEMENT TRANSVERSE JOINTS

DESCRIPTION

1. Field of the Invention

This invention relates to an improved load transfer device for transverse joints between adjacent concrete pavement panels.

2. Description of the Prior Art

Doweled transverse joints are designed to provide load transfer between adjacent concrete panels, confine pavement cracking to predetermined locations directly over the steel dowel bar assemblies and minimize faulting of concrete panels at the joint area. The type of transverse joints currently utilized has been recognized by Federal Research studies as the cause of 90 to 95 percent of all concrete pavement performance problems. This deficiency limits the life of otherwise durable concrete material to 15 to 25 years of services.

Without adequate joints, the concrete pavement material will develop eratic random cracking. This is due to the initial cure shrinkage of the concrete material and also the ultimate expansion and contraction of the concrete pavement with temperature change. Steel dowel bars at transverse joint locations have provided the most accepted means of load transfer. With this current state of the art techniques, the steel dowel bar assemblies are placed upon the subgrade prior to the placement of the concrete material. In order to insure that shrinkage cracks occur at the predetermined locations partial saw cuts are made directly over the load transfer dowel bars. This initial sawing is accomplished as soon as the concrete material will permit without raveling and before random shrinkage cracks occur. Also, a method of placing inserts prior to the final screeding of the concrete pavement surface has been utilized. Both of these methods of controlling the initial pavement cracking create some potential adverse results. Sawing can cause raveling and random cracking can develop if the sawing is not accomplished soon enough. The vibrating of the insert technique has proven to cause some loss of air content within the concrete material with attendant reduction of durability.

Major contributing factors to the deterioration of the transverse joint area, are related to excessive stress condition within the confined area. During periods of colder temperatures the transverse joints become open to the maximum. Often upper joint sealants lose resiliency during colder temperatures and fail to compensate for the opening of the joint. Even under ideal conditions the life of most poured sealants rarely exceeds three years. This limited life often leaves the open joint area very susceptible to intrusion of fluids and non-compressibles. The moisture and chemicals which pass through the open joint are absorbed into the underlying supporting subgrade material. This excessive accumulation of moisture within the confined area of the transverse joint will cause increased frost expansion of subsoils beneath the joint area. As frost leaves the ground increased subgrade elasticity will also occur. As load transfers of traffic weights are made across adjacent rigid concrete panels, hydraulic pumping of fluid subsoils will cause non-compressibles to be impounded into the open joints. The impoundment of these non-compressibles are a major cause of deterioration of the joints. When temperatures increase, during the summer, these collected non-compressibles will settle within the confines of the lower portion of the joint. As expansion of the concrete panels occur, the restricted lower portion of the transverse joint will absorb the total compressive demand of the closing of the joint. This will rupture the concrete material at the lower portion of the joint and begin a cycle of triangular deterioration growth. Subsequent cycles of this phenomena will cause the deterioration triangle to enlarge until the upper apex of the triangle will appear at surface level.

At this point the entire joint area becomes susceptible to increased moisture intrusion resulting in increased subgrade elasticity. The rigid steel dowel bar will induce added bending moment stress within the weakened concrete area. This will result in rapid complete failure of the joint system and potential faulting can occur.

It is the object of the invention to provide a load transfer system for concrete pavements which will provide an improved method of load transfer and will resist deterioration of concrete, providing longevity to the transverse joint area.

SUMMARY OF THE INVENTION

The load transfer cell assembly of the invention is designed to replace the current state of the art dowel bar assembly for load transfer of jointed concrete pavement panels. This invention functions to provide an improved method of load transfer. The load transfer cell consists of two vertical symmetrical walls which are attached to a base section and spaced apart with compressed elastomers to form an upright open joint cell between adjacent concrete pavement panels. The plastic wall liners and base section seal off the adjacent side walls of the concrete structure from absorption of harmful moisture and chemicals. It forms an open cell which allows water, chemicals and non-compressibles to migrate to a lower drainage trough which funnels these materials to the ouside ends of the pavement joint. The drainage trough is formed as a connecting member for the base support chairs with provisions to receive a continuous flexible trough where two or more pavement widths flow in the same direction. Lateral movement of moisture, chemicals and non-compressibles is provided to current state of the art edge drain systems (not shown). The drainage trough is preferably sized to permit periodic flushing and removal of non-compressibles with a high pressure water jet and vacuum system. The drainage trough should therefore be accessible at both ends of the load transfer cell joint. Removable end closure caps seal off the joint edge from shoulder material. The drainage trough is preferably raised above the pavement subgrade to prevent its damage.

An example of this type of joint is disclosed in my co-pending U.S. patent application Ser. No. 495,776 entitled Transverse Joint Cell For Concrete Structures and filed May 18, 1983 which application is hereby incorporated herein by reference thereto. Reference may be thereto for further information on the construction of corresponding parts.

The uppermost portion of the load transfer cell provides a forming guide to wet form the uppermost portion of the concrete joint. The upper connecting tie for the vertical side walls is designed to initially exclude the wet concrete material from the open cell while the concrete material is being placed. The connecting tie is provided with perforations longitudinally through its center which splits as the upper joint forming head (not shown) passes through. After the joint has cured the upper concrete joint is sawn to establish perfect parallel upper joint side walls. In my present invention disclosed and claimed herein, load transfer elastomers, preferably formed of natural rubber to provide compressibility are compressed between the symmetrical wall liners. These load transfer elastomers are compressed by dowel encasing sleeves and are designed to supplement the steel dowel bars in providing load transfer of traffic weights across adjacent concrete panels. This design causes the friction between the compressed elastomeric surfaces and compression washers of the sleeve to assume part of the load transfer and will allow the use of a reduced diameter steel dowel bar, which in combination with load transfer elastomers, distribute the load transfer across a greater area of the transverse joints.

The encasement sleeves, which house the concrete embedded portion of the dowel bars, provide a means to pre-compress the elastomers and provides bulge retention chambers to absorb rubber displacement within the joint walls. Pre-compressed rubber because of its compressibility provides a natural compatibility toward load transfer. During the winter, joints will open reducing compressive load transfer within the elastomers; the subgrade, being frozen, will not yield to traffic weights during this period.

As frost leaves the ground and subgrade elasticity develops, increased compressive load transfer will occur with the tightening of the joint walls. Two types of load transfer compression systems are distributed within the open cell. Both systems are designed to release constrained compression within elastomers upon contraction of the concrete which defines the joint..

The primary load transfer cells include a threaded encasement sleeve which extends to the outer longitudinal edge of the load transfer cell assembly. The end portion of the threaded encasement sleeve provides a means for receiving a support chair, which affixes to subgrade surface level tie rods.

The supplementary load transfer cells which are smaller and do not extend as far into the concrete material are spaced between the primary load transfer cells, so as to allow vertical movement of moisture, chemicals and non-compressible material to the drainage trough.

The elastomers function as spacers between the adjacent wall liners during the concrete placement operation. Compressed elastomers provide constant pressure against adjacent joint walls assuring equal joint spacing at all times.

DETAILED DESCRIPTION OF THE INVENTION

Referring to FIGS. 1, 2, 3 and 4 symmetrical wall liners (10) and Base Section (14) are plastic extrusions which attach to form an impermeable wall liner for concrete pavement joint walls. Plastic, as used herein, includes thermoplastic and thermosetting polymers. The preferred plastic, such as polyvinyl chloride, is resistant to road chemicals and has a coefficient of expansion compatible with concrete material.

This invention includes a complete load transfer system for concrete pavements which provide some resiliency to reduce load transfer stress. Two types of load transfer cells include primary load transfer cells herein referred to as primaries and supplementary load transfer cells herein referred to as supplementaries.

The vertical plastic wall liners (10) form an open cell, are held apart by compressed elastomers (29) and (30). The compressed elastomers are of a resilient thermoplastic material with resistance to road chemical deterioration. The preferred material is a natural rubber which compresses to about 60 percent of its original dimension when subjected to about 750 pounds per square inch of pressure. It should rebound to at least 95 percent of its original dimension when pressure is released. Preferably, natural rubber material rebounds to about 98 percent of its original dimension.

Figure 1:
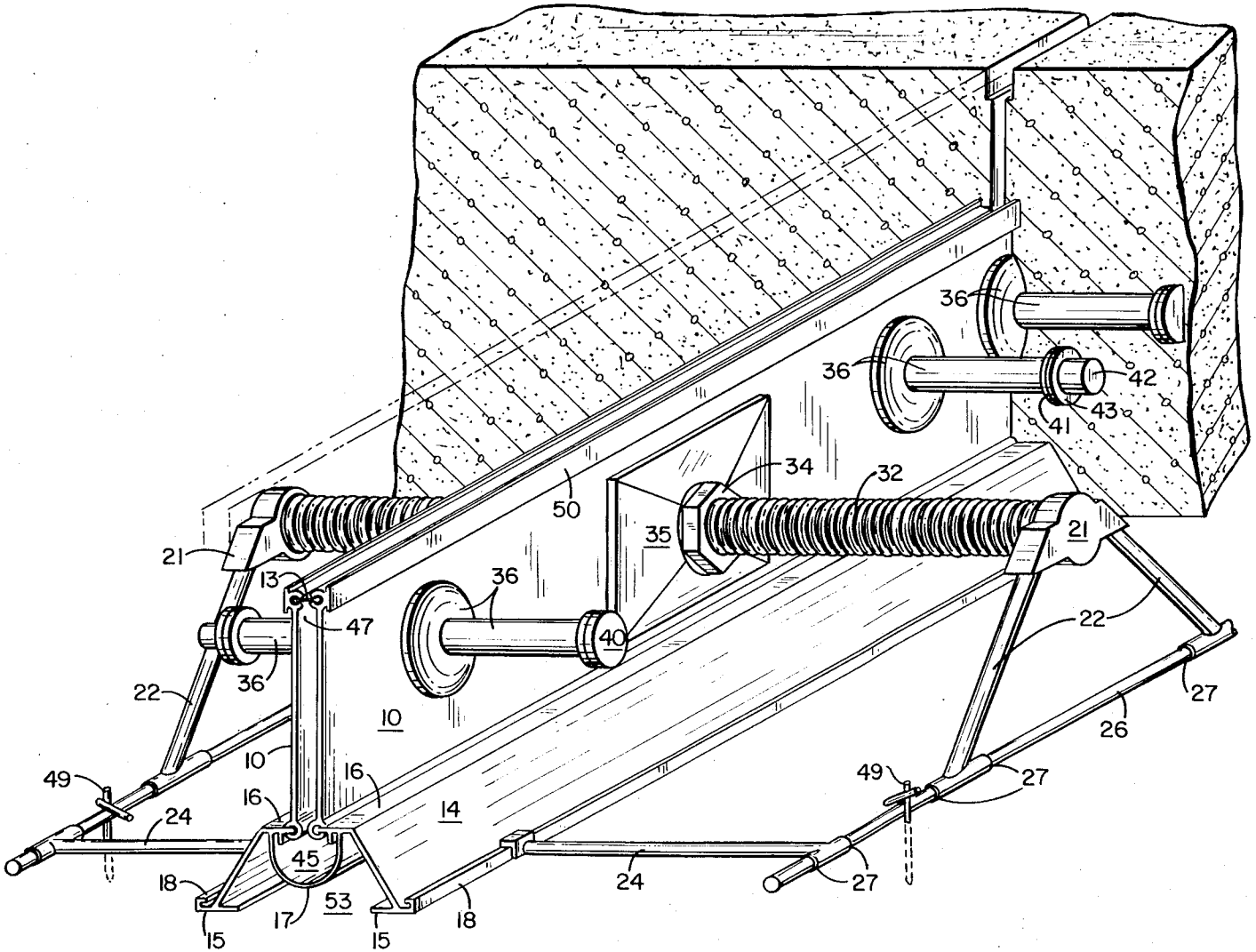
FIG. 1 is a perspective view in cabinet projection of a joint with portions of the concrete mass indicated by phantom lines.
Figure 2A:
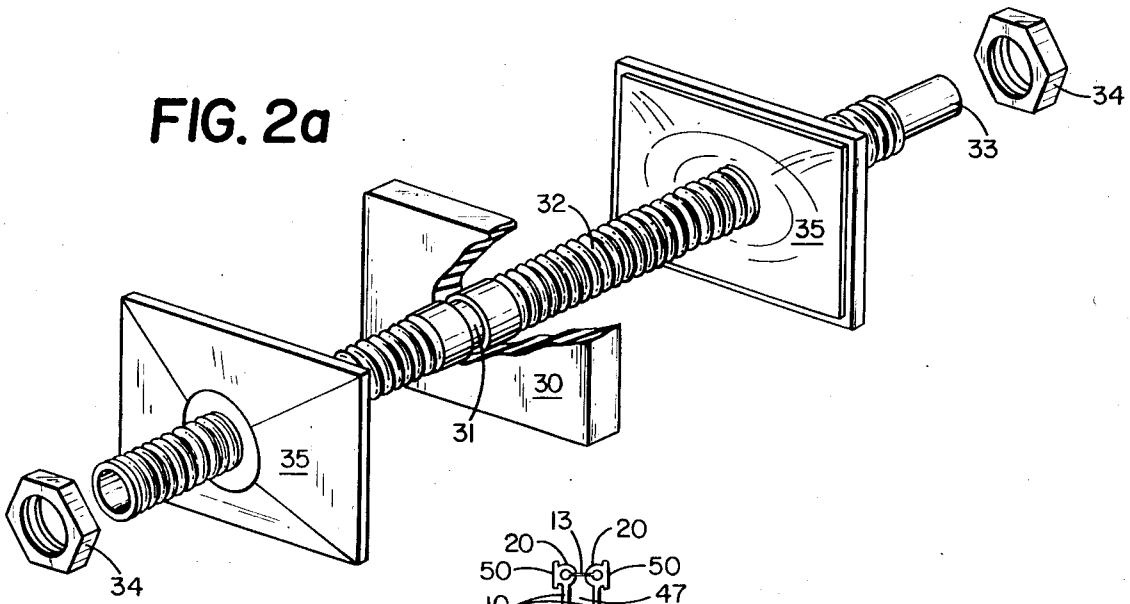
FIG. 2*a* is a perspective view on an enlarged scale of a primary load transfer cell in isometric and exploded.
Figure 2:
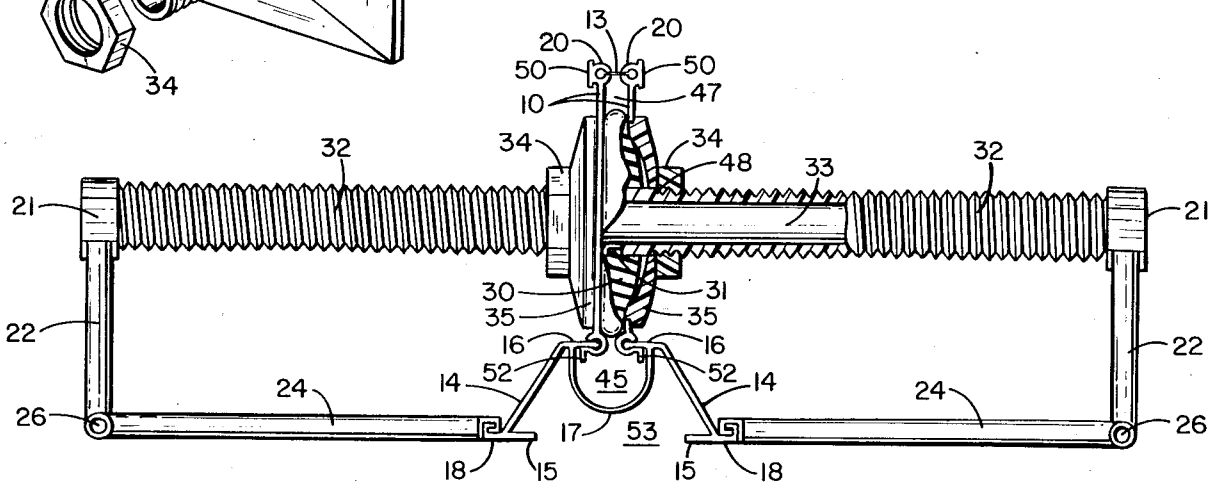
FIG. 2 is a side elevation view of the elements of the primary load transfer cell with parts broken away and shown in cross section.
Figure 3A:
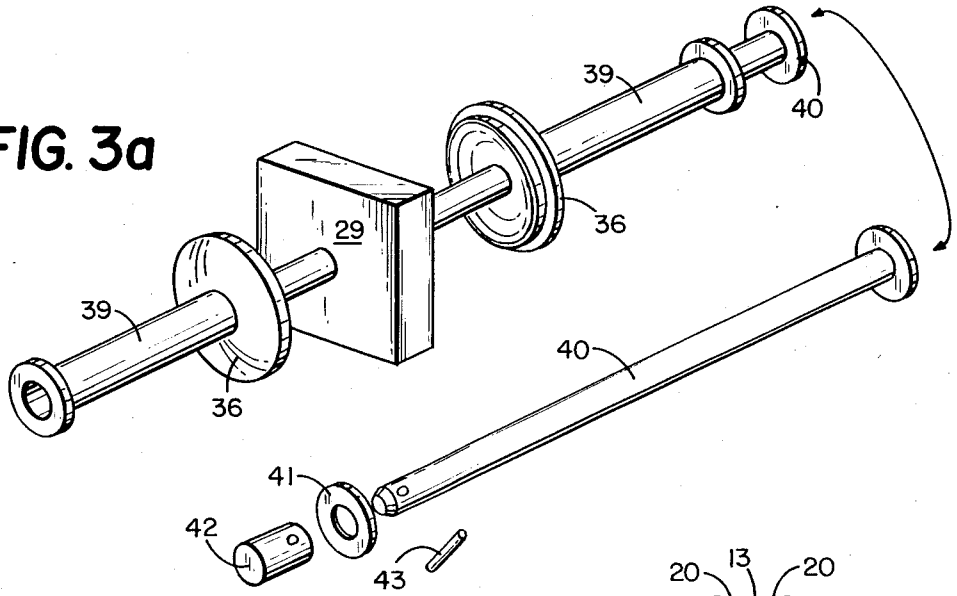
FIG. 3*a* is a perspective view on an enlarged scale of a Supplementary load transfer cell in isometric and exploded.
Figure 3:
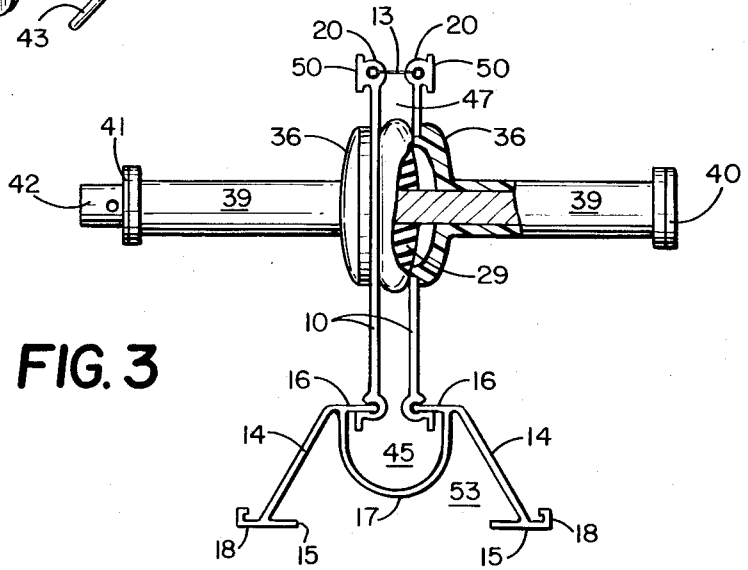
FIG. 3 is a side elevation view of the elements of the supplementary load transfer cell with parts broken away and shown in cross section.
Figure 6:
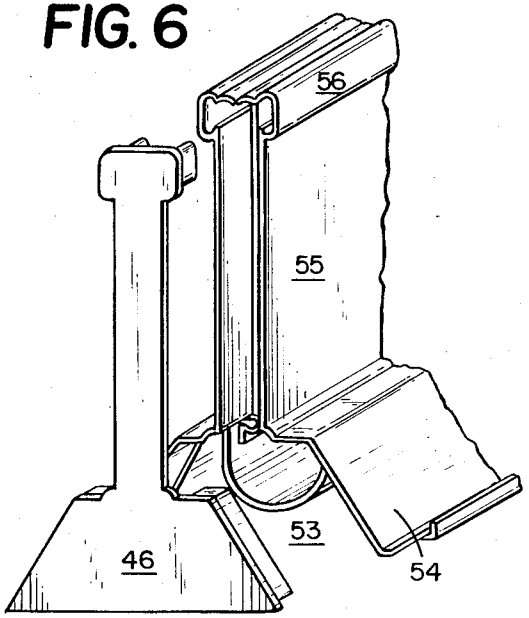
FIG. 6 is a perspective view in cabinet projection of a removal end cap.
Figure 4:
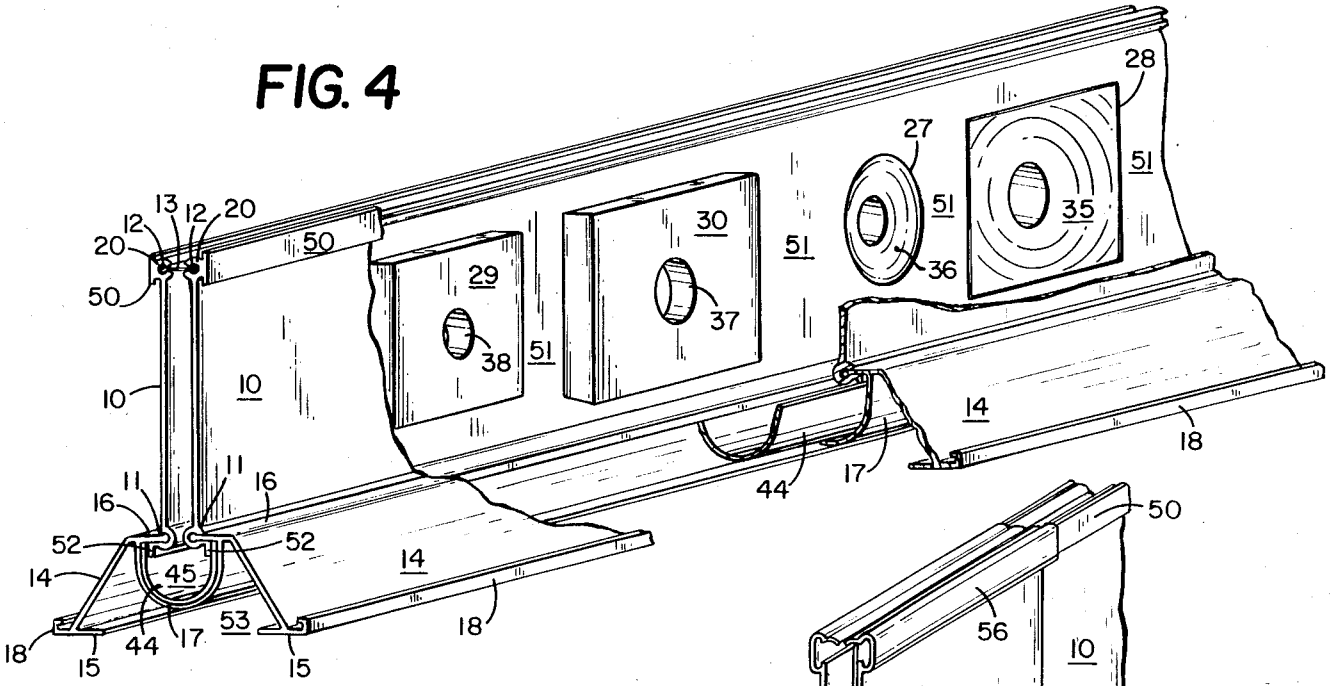
FIG. 4 is a perspective view of a joint extrusion assembly in cabinet projection with parts broken away, with elastomer compression blocks covering similar to those shown immediately to their right.
Figure 5:
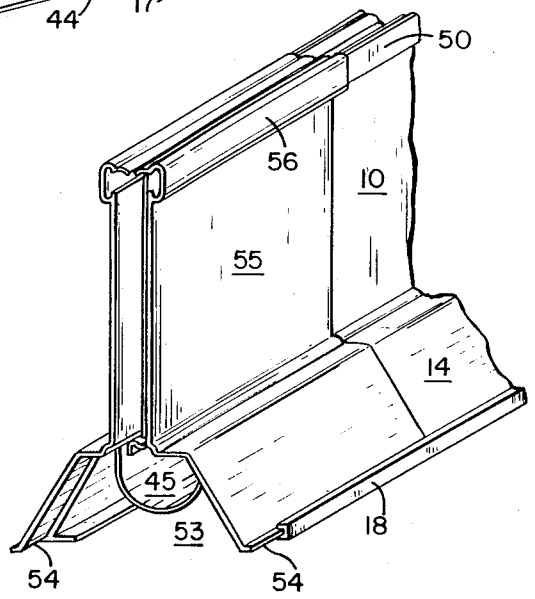
FIG. 5 is a perspective view in cabinet projection of a combination retractable sleeve (shown) or to be used as a connector section.

The perimeter sizing of the uncompressed elastomer (29) and (30) shall be larger than openings (27) and (28) which are provided through vertical plastic wall liners (10) through which primaries FIG. 2 and supplementaries FIG. 3 pass through. Elastomers (29) and (30) are spaced apart from each other to cover openings (27) and (28) respectively and thereby define vertical openings (51) to allow moisture, chemicals and non-compressibles to pass freely to drainage trough (17) or (44). Non-compressibles, as referred to herein, refers to concrete chips, loose aggregates and plastic soils.

Base support section (14) positions the vertical plastic wall liners (10) to the proper elevation above the pavement subgrade. The base support section includes Horizontal members (15) and (16) which function to provide greater rigidity to the wall liners during the concrete placement operation.

The base support (14) connecting member (17) provides a lower drainage trough which functions to collect intrusion of moisture, chemicals and non-compressible material which enter through failing upper joint sealants. The drainage trough (17) and (44) shall direct these material to, current State of the Art, edge drain systems (not shown). The exposable ends of the load transfer cell (45) shall be accessible for periodic inspection from the outer concrete pavement edges. The drainage trough area (45) shall be of sufficient size to permit periodic removal of non-compressible material therewithin by a flushing or vacuum cleaning. Preferably, drainage trough (17) is elevated above the subgrade to prevent its damage due to frost heave.

The removable end cap (46) closes the cell ends from intrusion of shoulder aggregates. The drainage trough area (45) also provides for a means for receiving a secondary continuous drainage trough (44) which is utilized where drainage flow direction is continuous for two or more pavement widths. Continuous drainage trough guides (52) provides a means for receiving and directing the continuous drainage trough (44) through a multiple of pavement widths. The lower connecting member which forms the drainage trough (17) also provides a seal to disallow impoundment of subsoils within the vertical walls of the transverse joint area. Voided area (53) provides a collector for discharged non-compressibles which collect through hydraulic pumping of subsoils. The support legs of the base section (14) are tapered to force non-comressibles back into the subgrade as adjacent concrete panels expand. The inner and uppermost portion of the wall liner (10) include receiving channels (20) which receive enlarged edges of the perforated connecting tie (13). Perforated connecting tie (13) provides the initial function of tying the wall liner (10) together and also functions to exclude the wet concrete material from within the load transfer cell during the concrete paving operation. The confined area (47) directly below the connecting tie (13) and above elastomers (29) and (30) provides an upper joint forming guide (47) which receives a vibrating joint forming head (not shown) to wet form the concrete pavement joint to the surface. The midpoint of the upper connecting tie (13) is thereby split at the perforations, along its center, as the upper joint forming head passes through.

When the concrete material has hardened, the wet formed portion of the concrete joint is sawn above the load transfer cell to establish perfect parallel side walls. Perforated connecting tie (13) is also sawn through in order to insure uninterrupted vertical movement of fluids and non-compressibles to the lower drainage trough (17) or (44). A conventional State of the Art joint sealant is used to seal the upper concrete joint.

At uniform spacing along the vertical side walls (10) a combination of circular (27) and square holes (28) are cut to receive plastic washers (35) and (36) which function to absorb displacement bulging of the elastomers as they are compressed there between. Rubber has the physical properties needed to function for many years with modern protective agents and can store more elastic energy than steel. Rubber material is resistant to most inorganic acids, salts and alkalies and therefore has been widely used for bridge bearing pads. The very high bulk modulus means that rubber hardly changes in volume even under high loads, so that for most types of deformation there must be a space into which the rubber can deform or flow. Plastic washers (35) and (36) provide for cavities to absorb the displacement bulging of the elastomers as compression is applied to primary and supplementary load transfer cells.

The primaries (FIG. 2) are designed with a means to pre-compress the elastomers with 500 pounds per square inch compression prior to placement. Threaded plastic dowel bar encasement sleeve (32) passes through the primary load transfer compression elastomers which are aligned between the vertical wall liners (10). Primary plastic washer (35) is positioned into receiving hole (28) for proper alignment. By drawing plastic compression nuts (34) to the calibrated thread stop (48) position, the required compression will be constrained within the elastomer. The threaded plastic encasement sleeve (32) is designed with a reduced breakaway section (31). This area is provided to withstand the initial induced compression. Breakaway section (31) will fracture upon the first excessive joint opening as adjacent concrete panels contract, thereby creating two separate sleeve elements and cause the friction between the compressed elastomers (30) and the concrete embedded washer of each to bear part of the load transfer. This will release the stored elastic energy, supplementing the steel dowel bar (33) towards providing load transfer between adjacent concrete panels.

The primaries (FIG. 2) also provides a means to attach support chairs (21) and (22) at the outer longitudinal edges. Chair support caps (21) attach to the threaded plastic dowel bar encasement sleeve ends which receive chair legs (22). The support chair attaches to a longitudinal steel subgrade tie (26). Longitudinal steel subgrade tie (26) is a continuous round steel rod which receives open tees which secures its members. Longitudinal steel subgrade tie (26) is provided to withstand abuse of placing subgrade pegs (49) which secure the load transfer cell to the underlying subgrade. Crimping at points (27) of the longitudinal steel subgrade tie (26) at ends of each connecting tee provides a lock to secure positioning of all members.

Lower embedment receiving channel (18) is provided to function as an embedment interlock, sealing the concrete pavement from intrusion of lower interface moisture flow; it also provides a receiving channel to attach stabilizing ties (24) to the longitudinal steel subgrade tie (26). Supplementaries (FIG. 3) are spaced between primaries (FIG. 2) to supplement load transfer with load transfer compressed elastomers. Supplementary compression blocks (29) are positioned within side walls (10) at the center of Supplementary receiving holes (27) which provides supplementary bulge retention chamber (36). Supplementary compression dowel bar (40) passes though the washer (36) and supplementary compression elastomer (29). By means of mechanical compression the washers (36) compress the elastomer block (29) to about 500 pounds per square inch compression. Epoxy coated washer (41) and end play cap (42) are provided to constrain compression within the elastomer material by placing plastic sheer pin (43) through holes provided. Plastic sheer pin (43) will withstand induced compression within the elastomeric material; however, it will sheer and release constrained elastic energy with the first joint opening as adjacent concrete panels contract. The releasing of the constrained compression within the elastomers (29) and (30) will also provide a compression seal to exclude moisture and chemicals from the steel dowel bar. Primary elastomer receiving hole (37) is also sized with a smaller diameter hole than steel dowel bar (33) diameter to provide a secondary seal of breakaway section (31).

From the above it can be seen that my invention provides a substantial reduction of the load transfer of the steel dowel bars and the assumption of the same by the compressed elastomer blocks within my new load transfer cell. This is accomplished immediately upon the fracture of the reduced breakaway section (31) and/or shearing of the pin (43) whereupon the friction between the concrete embedded washers and the surfaces of the elastomers blocks compressed there between, function as a load transferring connection between the two adjacent concrete panels. This, in turn, reduces the load transfer stress from a confined area and distributes the same over a greater area with resultant lesser bending moment stress and consequent damage.

In addition, an effective protective seal is provided for the dowel bar.

I claim:

1. A load transfer cell assembly for concrete structure comprising:

(a) elongated liner means for disposition between adjacent end portions of end to end concrete slabs;

(b) said liner means including a pair of panels each extending vertically in a single plane and defining an open cell therebetween and being spaced apart in substantially parallel relation such that a plurality of compressible block may be inserted therebetween;

(c) said liner means further including gutter means extending longitudinally between said vertically extending panels and therebetween in position to collect and drain away fluid which may pass downwardly therebetween;

(d) plurality of compressible and resilient blocks disposed between said vertically extending panels throughout the portions thereof intermediate the ends of said panels in spaced apart relation so as to provide vertical drainage openings therebetween to allow fluid to pass to said gutter means;

(e) means for securing said liner means to a load transferring dowel bar assembly of such concrete slabs; and (f) mechanical compression means engaging opposite sides of said compression blocks and holding the same under compression therebetween at all times, said compression means being constructed and arranged to extend between adjacent ends of such concrete slabs and to be rigidly secured thereto whereby a load carried by one of such slabs will be transferred in part of least through said compression means and said compression blocks to the other of such slabs.

2. The structure defined in claim 1 wherein said compression means includes said securing means.

3. The structure defined in claim 1 wherein said compression means is constructed and arranged to encase such a dowel bar assembly.

4. The structure defined in claim 1 wherein said compression means includes threaded compression applying members.

5. The structure defined in claim 1 wherein said compression means has concave compression-block-engaging surfaces constructed and arranged to receive within its concavities compressed portions of said blocks.

6. The structure defined in claim 1 wherein said compression means is tubular in form and constructed and arranged to receive a dowel bar therewithin in encased relation.

7. The structure in claim 1 wherein said compression means is tubular in form and has a threaded exterior and at least one of said blocks to be compressed thereby.

8. The structure defined in claim 7 wherein said externally threaded tubular compression means is constructed and arranged to be fixedly incorporated within adjacent end portions of end to end concrete slabs.

9. The structure defined in claim 1; and (g) a dowel bar mounted within said compression means and extending longitudinally thereof, said dowel bar and said compression means being constructed and arranged to be encased within adjacent ends of such concrete slabs and to extend therebetween, each in load transferring relation.

10. The structure defined in claim 1, and (g) a pair of concrete slabs arranged in end to end relation and having adjacent ends;

(h) said compression means being encased within said adjacent ends of said concrete slabs and extending therebetween with said liner means being displaced between said ends; and (i) a dowel bar encased within said compression means and extending between said adjacent ends;

(j) each of said compression means and said dowel bar being constructed and arranged in load transferring relation between said concrete slabs.

11. A load transfer cell assembly for concrete structures comprising:

(a) elongated liner means for disposition between adjacent end portions of a pair of end to end concrete slabs;

(b) said liner means including a pair of vertically extending panels each extending in a single vertical plane and defining an open cell therebetween and being spaced apart in substantially parallel relation such that a plurality of compressible blocks may be inserted therebetween;

(c) said liner means further including gutter means extending longitudinally between said vertically extending panels and therebetween in position to collect and drain away fluid which may pass downwardly therebetween;

(d) a plurality of compressible and resilient blocks disposed between said vertically extending panels throughout the portions thereof intermediate the ends of said panels in spaced apart relation so as to provide vertical drainage openings therebetween to allow fluid to pass to said gutter means;

(e) means for securing said liner means to a dowel bar assembly of said concrete slabs; and (f) said securing means including continuous mechanical compression means constructed and arranged to be carried by the adjacent ends of such concrete slabs at opposite sides of said compressible blocks and compressing the same at all times therebetween.

12. The structure defined in claim 11, wherein (g) said compression means is arranged to extend between adjacent ends of such concrete slabs and to be rigidly secured to each whereby a load carried by one of such slabs will be transferred in part at least to the other of such slabs through said compression means and said compression blocks.

13. The structure defined in claim 11, and (g) a dowel bar;

(h) externally threaded sleeve means encasing said dowel bar and constructed and arranged to be embedded within adjacent ends of two such concrete slabs;

(i) compression transmitting means carried by opposed threaded portions of said sleeve means at opposite sides of one of said compressible blocks; and (j) internally threaded compression applying means carried by said sleeve means and bearing against said compressor transmitting means at opposite sides thereof and causing said compression block to be compressed by said compression transmitting means.

14. The structure defined in claim 11, and (g) a dowel bar;

(h) sleeve means extending longitudinally of said dowel bar and encasing the same, said sleeve means including separate compression means spaced longitudinally of said bar;

(i) one of said compression block being carried by said dowel bar and being interposed between said separate compression means; and (j) mechanical means carried by said dowel bar for causing said compression means to maintain said compression block under pressure therebetween.

15. The structure defined in claim 11, and (g) a dowel bar;

(h) sleeve means extending longitudinally of said dowel bar and encasing the same;

(i) said sleeve means including separate sleeve portions having adjacent ends;

(j) a compression member carried by each of said sleeve portions at its said having adjacent end;

(k) one of said compression block being carried by said dowel bar and interposed between said compression members and being compressed therebetween; and (l) mechanical means carried by said dowel bar for compressing said compression block to cause at least a portion of the load transfer normally carried by said dowel bar to be carried by said compression block and said compression members.

16. A load transfer cell assembly comprising:

(a) a water-permeable liner means disposed between adjacent transverse joint edges of concrete pavement;

(b) said liner means defining an open cell therebetween and included a pair of spaced liner panels each extending in a single vertical plane and defining said open cell;

(c) support means for supporting said liner means;

(d) compressible and resilient block means for absorbing compression due to expansion of adjacent concrete panels, and disposed between and throughout the length of said liner means and being constructed and arranged to allow fluids to pass freely downwardly in the joint cell;

(e) seamless drainage trough means extending transversely through said open cell and in fluid tight relation to said liner means and being constructed and arranged below said compression block means;

(f) a dowel bar assembly extending between said adjacent transverse joint edges of concrete pavement and embedded within said pavement;

(g) means for securing said liner means to said dowel bar assembly; and (h) mechanical compression means engaging opposite sides of said block means and holding the same at all times under compression therebetween, said compression means extending between said joint edges of concrete pavement and being embedded in the concrete pavement whereby a load carried by said concrete adjacent one of said joint edges will be transferred in part at least through said compression means and said block means to the concrete adjacent the other of said joint edges.

17. The structure defined in claim 16 wherein at least a portion of said dowel bar assembly is encased within said compression means.

18. The structure defined in claim 16 wherein said compression means includes mechanical means for applying pressure to opposite sides of said block means.

19. The structure defined in claim 16 wherein said compression means includes threaded pressure-applying means.

20. The structure defined in claim 16 wherein said compression means includes concave surfaces engaging said block means and receiving compressed portions of said block means therewithin.

* * * * *

UNITED STATES PATENT AND TRADEMARK OFFICE

CERTIFICATE OF CORRECTION

PATENT NO. : 4,648,739

DATED : March 10, 1987

INVENTOR(S) : Bernard D. Thomsen

It is certified that error appears in the above-identified patent and that said Letters Patent is hereby corrected as shown below:

Claim 1, line 9, "block" should read "blocks";

Claim 1, line 32, change "of" to "at".

Signed and Sealed this

Fifteenth Day of March, 1988

*Attest:*

*Attesting Officer*

DONALD J. QUIGG

*Commissioner of Patents and Trademarks*